United States Patent [19]

Dick et al.

[11] 3,935,494

[45] Jan. 27, 1976

[54] SINGLE SUBSTRATE PLASMA DISCHARGE CELL

[75] Inventors: George Wilmer Dick, Colts Neck; Walter Bryan Hatfield, Fair Haven, both of N.J.

[73] Assignee: Bell Telephone Laboratories, Incorporated, Murray Hill, N.J.

[22] Filed: Feb. 21, 1974

[21] Appl. No.: 444,380

[52] U.S. Cl. ..... 313/190; 313/201; 313/217; 313/220

[51] Int. Cl.[2] ..... H01J 61/067; H01J 61/10; H01J 61/30

[58] Field of Search ..... 313/494, 201, 210, 188, 313/220, 217, 190

[56] References Cited

UNITED STATES PATENTS

| | | | |
|---|---|---|---|
| 3,684,918 | 8/1972 | Schmersal | 315/169 TV |
| 3,787,106 | 1/1974 | Schermerhorn | 313/220 X |
| 3,811,061 | 5/1974 | Nakayama et al. | 313/217 X |
| 3,860,846 | 1/1975 | Mayer | 313/220 X |

*Primary Examiner*—Palmer C. Demeo
*Attorney, Agent, or Firm*—W Ryan

[57] ABSTRACT

A gaseous display device with memory is disclosed which requires only a single dielectric substrate with layers of orthogonal conductors laid thereon, which layers are separated by a dielectric layer. The substrate and layers thereon are enclosed in a gaseous environment with conductors brought through an envelope to facilitate the application of a.c. signals. Dielectric barriers are conveniently established on the substrate to control the shape of the individual discharges and to prevent crosstalk.

3 Claims, 12 Drawing Figures

SINGLE SUBSTRATE PLASMA DISCHARGE CELL

BACKGROUND OF THE INVENTION

1. Field of the Invention

The present invention relates to gaseous display and/or memory systems. More particularly, the present invention relates to plasma gas discharge cells and arrays thereof. Still more particularly, the present invention relates to such cells and arrays disposed on a single substrate.

2. Description of the Prior Art

The subject of gaseous display and memory systems has recently received considerable attention. Such systems utilizing the glow discharge phenomenon resulting from the application of electric fields to one or more inert gases possesses negative impedance characteristics and, therefore, inherent memory. Thus, rather than requiring constant refreshing by a separate source of signals it is sufficient for such gaseous display systems to have applied to them an initial set of signals defining a desired on/off pattern. Maintenance of the resulting glows is achieved by the application of a non-information-bearing sustain signal sequence of lesser magnitude than those signals used to write the information in the first instance.

A typical configuration for such gaseous display/memory systems assumes the form of a so-called plasma discharge panel of the type described, for example, in U.S. Pat. No. 3,559,190 issued Jan. 26, 1971 to D. L. Bitzer et al. The basic structure of a plasma panel in accordance with the teachings of Bitzer et al. includes a "sandwich" of three dielectric layers, the outermost ones of which have mutually orthogonal sets of conductors plated or otherwise laid upon the exterior surface thereof. The intermediate dielectric layer typically has a plurality of perforations therein, with one perforation appearing at the "intersection" of the conductors on the exterior dielectric layers. Thus when the three layers are brought together in typical embodiment there is formed a cavity containing neon, argon, or some other inert gas (or some combination thereof) in which a glow discharge formed by potential differences created on the exterior conductors may be maintained.

Since the discharge is formed between the sets of conductors, it is necessary, if any useful light is to appear on the exterior of the sandwich, that the conductors be transparent to some substantial degree. As might be expected, however, in practice a significant portion of the light actually generated is absorbed by the conducting electrodes.

It is, therefore, an object of the present invention to provide a plasma discharge panel wherein little or no light is masked by the driving electrodes.

Another obvious characteristic of the Bitzer et al display panel is that the outer layers of the three layer sandwich must be maintained in constant spaced-apart relation in order to maintain uniform discharge characteristics over a matrix of many conductor intersections or cells. While the intermediate dielectric layer having perforations therein serves to provide some degree of constancy with respect to the separation of the exterior layers, nevertheless it introduces other alignment problems requiring that the perforations be lined up with considerable exactitude with respect to the intersection of conductors. Other spacing means have been used from time to time to maintain a uniform spacing between the conductor-bearing dielectric layers. Thus, for example, individual dielectric spheres of the correct diameter have been used in some cases to provide the proper spacing. In actual manufacture, however, some degree of compression of the spheres in a position-dependent manner occurs. Other efforts utilizing spacers of the form of fiber optic tubes have met with similar disadvantages and resulting lack of uniformity of spacing.

It is, therefore, an object of the present invention to eliminate the need for spacers defining a gas-filled cavity between conductors for purposes of developing a uniform glow discharge at cells disposed on a two-dimensional panel.

In U.S. Pat. No. 3,603,836 issued Sept. 7, 1971 to J. D. Grier, an alternative panel structure is provided in which electrodes on each of the exterior layers of a panel sandwich are bifurcated to, in effect, generate a discharge which is not wholly obscured by the conductors. In typical operation the Grier panel causes a discharge to occur under the space between each of the bifurcated portions of a conductor path. The Grier systems, however, requires that the conductor-bearing layers be maintained in constant spaced-apart relation, thereby sharing the difficulty in fabrication with the Bitzer et al. system.

U.S. Pat. No. 3,602,756 issued Aug. 31, 1971 to R. E. Bonnet describes a plasma panel which comprises a woven wires mesh of non-electrically contacting intersecting wires in place of conductors disposed on planes having constant separation. Again, fabrication difficulties can arise in such systems by virtue of the required "weaving" operations. Thus the process does not lend itself to such modern fabrication techniques as thin or thick film deposition on planar substrates. Also, because the Bonnet structure is not planar, it may prove difficult to introduce isolating structures intermediate the individual cells or crosspoints. Thus to avoid spurious ignition of one cell, it may be necessary to separate it from an adjacent ignited cell by a considerable physical difference. High resolution displays are therefore more difficult to realize using the Bonnet system.

U.S. Pat. No. 3,646,384 issued Feb. 29, 1972 to F. M. Lay describes a so-called "one-sided plasma display panel." The panel shown three points out many of the difficulties enumerated above for the three-layer sandwich panels relating to spacing and the like. However, the structure proposed by Lay, which basically involves the plating on both sides of an insulating sheet, the whole then being enclosed within a neon atmosphere, was used with electrode spacing of one-third of an inch. Such spacing is, of course, not appropriate for use in panels requiring high crosspoint density, i.e., high resolution. In subsequent U.S. Pat. No. 3,719,940 issued Mar. 6, 1973, Lay describes an improvement to panels of the "one-sided" type. However, the improvements made relate to techniques for preventing firing or sustaining of unselected cells during addressing operations, which improvements relate to altering the drive pulse sequencing of a panel of the type described in U.S. Pat. No. 3,666,981 also issued to Lay on May 30, 1972. This latter patent describes a panel with a grid network of conductors intermediate the drive electrodes for purposes of enhancing the shielding therebetween.

It is therefore an object of the present invention to provide a "one-sided" or single-substrate plasma panel structure which permits the realization of high cell density.

SUMMARY OF THE INVENTION

In accordance with one embodiment of the present invention, the above objects are realized in a structure defining a plasma panel which comprises a single substrate on which are deposited two layers of orthogonal conducting paths separated by a dielectric layer. Individual cells are defined by reference to the area of intersection of orthogonal paths. The discharge at a cell occurs on the interface between the conductor farthest removed from the substrate and the intermediate dielectric layer. Accordingly, the complete glow is exposed to observation rather than being concealed behind the conductor or other structure.

Further, since the conducting layers are separated by a continuous dielectric sheet, it is not necessary to align any perforations or to maintain any other structural parameter other than uniformity of thickness in the dielectric layer.

In accordance with advantageous variations of the present invention there are provided a variety of conductor shapes and barriers formed between successive conductors associated with rows or columns in a matrix panel arrangement.

DETAILED DESCRIPTION

Figure 1:
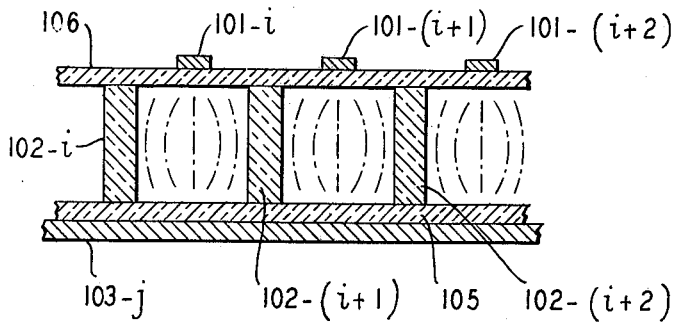
FIG. 1 PRIOR ART
FIG. 1 shows prior art plasma panel construction of the sandwich type including spacing elements.

FIG. 1 shows a typical prior art plasma discharge panel. A plurality of substantially parallel conductors **101-*i*, $i$=1,2 . . . ,N, are positioned on a substrate 106 in standard fashion. Similarly, a plurality of conductors 103-*j*, $j$=1,2 . . . ,M, are positioned on a second substrate 105, the conductors 103-*j* being positioned substantially perpendicularly with respect to conductors 101-*i*. The effect, then, when viewed in a plan view is that of a matrix of rows and columns, the intersections of which define plasma discharge cells. The substrates 105 and 106 are advantageously planar and are positioned in nominally parallel planes. To effect the required uniform spacing there is interposed between substrates 105 and 106 spacing means. This spacing means may typically assume the form of a perforated sheet with the perforations occurring at a location defined by the intersection of the sets of conductors 101-*i* and 103-*j*. The spacer appears in crossection in FIG. 1 as a plurality of vertical spaces 102-*i*.**

Figure 2:
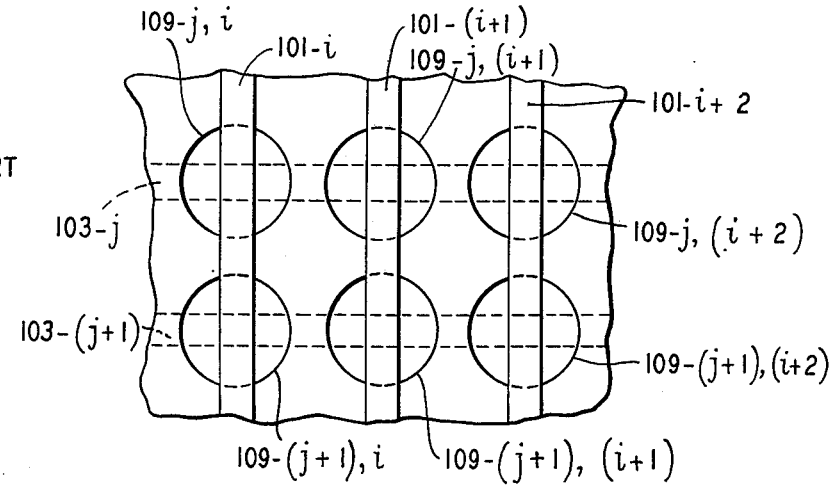
FIG. 2 PRIOR ART
FIG. 2 shows a plan view of the prior art panel of FIG. 1.

FIG. 2 shows a plan view of a panel of the type shown in FIG. 1. It is seen that the perforations **109-*j*,*i* may be associated on a one-to-one basis with the cells defined by the intersection of the sets of spaced-apart conductors 101-*i* and 103-*j*. In addition to providing the required spacing, it is seen that the perforated spacing medium 102** provides a further definition of the individual plasma cells.

When the whole of the panel shown in FIGS. 1 and 2 is enclosed in an appropriate gaseous atmosphere and suitable potentials are applied to the conductors, a discharge may be selectively realized at the intersection of the conductors **101-*i* and 103-*j*,** i.e., in the individual plasma discharge cells. It is clear that at least one of the conductors for a given cell should be transparent to facilitate the emission of visible light accompanying the discharge.

Figure 3:
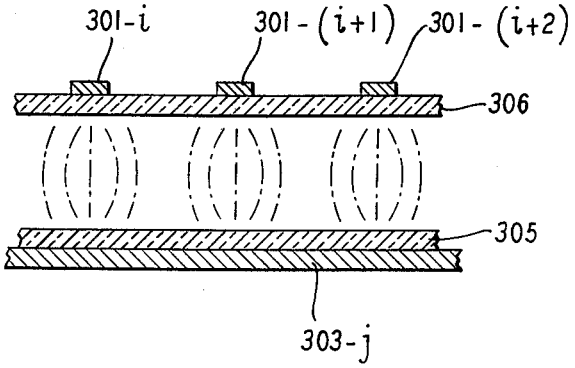
FIG. 3 PRIOR ART
FIG. 3 shows prior art plasma panel construction without intermediate spacing elements.

Other prior art plasma panels are typified by the structure shown in FIG. 3. There again, a plurality of conductors **301-*i* and a second plurality of conductors 303-*j* are shown positioned on respective substrates 306 and 305. In the structure in FIG. 3, however, no specific separating means such as the perforated or honeycombed separator 102 in FIG. 1 is explicitly included. The structure in FIG. 3 has been found to have the undesirable attribute that a discharge once established between a given conductor, say 301-*i* and an underlying conductor 303-*j*, tends to spread along conductor 303-*j* (when it is the cathode). This glow spreading, while desirable in some circumstances, is not preferred in those applications where the composite image is to be generated by the combined illumination of a pattern of individual matrix points. In the structure shown in FIG. 3, for example, it is clear that as sufficient spreading accompanies an initial discharge between electrodes 301-*i* and 303-*j*, the discharge may extend to an area primarily associated with electrode 301-($i$+1). The cell at that point may then be ignited erroneously. Similar glow spreading may proceed in a leftward direction in FIG. 3 or, when one of the top electrodes 301-*i*** is a cathode, along such cathode.

Figure 4:
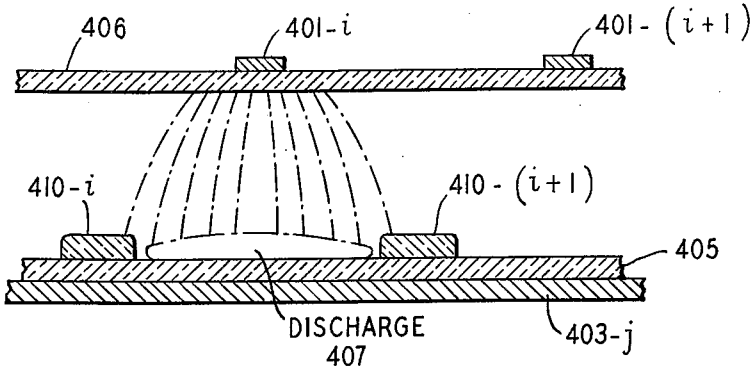
FIG. 4 shows an adaptation, in accordance with the teachings of the present invention, of the structure of FIG. 3.

FIG. 4 shows a structure which illustrates in simple embodiment some of the features of the present invention. The structure in FIG. 3 is substantially duplicated with the exception that a plurality of dielectric barriers **410-*i*, $i$=1,2 . . . ,N, are positioned on top of substrate 405. The effect of these dielectric barriers is to confine the discharge to an area indicated in FIG. 4 as 407, thereby preventing the spreading of a discharge in a left-to-right direction along the plane defined by substrate 405. The dielectric barriers may be of any one of a variety of dielectric materials of the screenable solder glass type or may be silicate/ceramics deposited by spraying, rolling or other similar means. A preferred technique for constructing these dielectric barriers comprises laying them down on substrate 405** using standard thick film techniques. Accordingly, fabrication of the required discharge-confining structure is simple, economical and easily reproducible.

Figure 5:
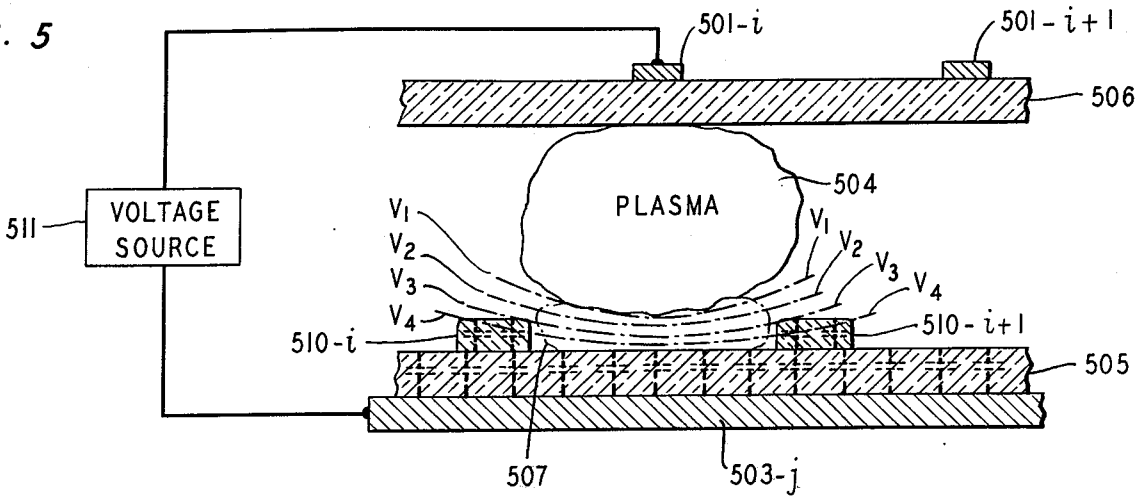
FIG. 5 shows in greater detail the plasma panel construction of FIG. 4 and an idealized representation of the plasma and discharge regions in operation.

FIG. 5 shows in greater detail the structure and operating environment of a plasma discharge cell having the structure indicated in FIG. 4. In particular, there are shown the now typical sets of electrodes **501-*i* and 503-*j* connected to an appropriate voltage source 511. These conductors are laid down on respective dielectric substrates 506 and 505. Barriers 510-*i* and 510-(*i*+1) are shown laid down on substrate 505. When the whole is enclosed in a typical gaseous atmosphere of 99 percent neon and 1 percent argon (and an initial minimum number of excited ions are provided by any one of several standard means), a plasma represented in FIG. 5 by the cloud 504 is formed and a discharge indicated as 507 appears in the gaseous atmosphere adjacent the cathodic element 503-*j*. Of course, when polarities are reversed in an a.c. operating mode, a discharge occurs adjacent substrate 506 in the vicinity of electrode 501-*i*. For present purposes, however, it will be assumed that the relevant discharge occurs when electrode 503-*j*** is the cathode.

In FIG. 5 the substrate 505, being a dielectric material, has represented on it a plurality of individual capacitors representing its distributed capacitance. While this capacitance will vary with the material, it is nevertheless characteristic of dielectrics in general. The effect of this capacitance is to facilitate the storage of charge associated with the a.c. operation of a plasma discharge cell and to provide, in part, the associated memory function.

The dielectric barriers **510-*i*, also being composed of dielectric materials present their associated distributed capacitance as indicated in FIG. 5. In the vertical direction in FIG. 5, therefore, there is, in effect, a series combination of capacitance extending from the top of dielectric barrier 510-*i* to the underlying electrode 503-*j*. This series combination is to be contrasted with the capacitance associated with the dielectric layer 505 in an area immediately below the top electrode 501-*i*. The total combined capacitance through dielectric barrier 510-*i* and the portion of substrate 505 lying below it is considerably less than that directly under the glow through substrate 505. Thus a much greater drop in potential occurs along the path through both barrier 510-*i* and the substrate 505. This drop causes a voltage to appear between the plasma and the barrier 510-*i* which is insufficient to produce a discharge. The effect, then, is to confine any discharge between the barriers 510-*i***, rather than to permit glow spreading to adjacent cells.

It is next worthwhile to consider this glow limiting feature in terms of the distribution of equipotential lines resulting from the application of positive and negative voltage signals between electrodes **501-*i* and 503-*j*, respectively, which gives rise to the plasma 504 and discharge 507. The plasma 504 will be found to have a relatively low voltage drop from an area adjacent substrate 56 immediately beneath electrode 501-*i* to points adjacent the discharge 507. Within the discharge 507 we find that a number of equipotential lines are formed. Since these equipotential lines extend in a closed fashion about the electrodes giving rise to the electric field, they extend through the dielectric barriers 510-*i*. It is seen that the additional capacitance introduced by barrier 510, when taken in combination with the underlying capacitance of substrate 505, is such taht an insufficient voltage exists across the gas immediately above dielectric layer 510 to cause a discharge at that point. Instead, a voltage divider effect is introduced in which an additional voltage drop across the thickened dielectric created by barriers 510-*i* causes an insufficient voltage ($V_1$–$V_3$) to be available between the top surface of dielectric barrier 510 (which is shown as being at a potential $V_3$) and the plasma (which is at potential $V_1$). Since $V_1$–$V_4$ is representative of the minimum potential which is required to establish and maintain a discharge in the chosen gaseous atmosphere, no glow is possible over barriers 510-*i***.

Figure 6:
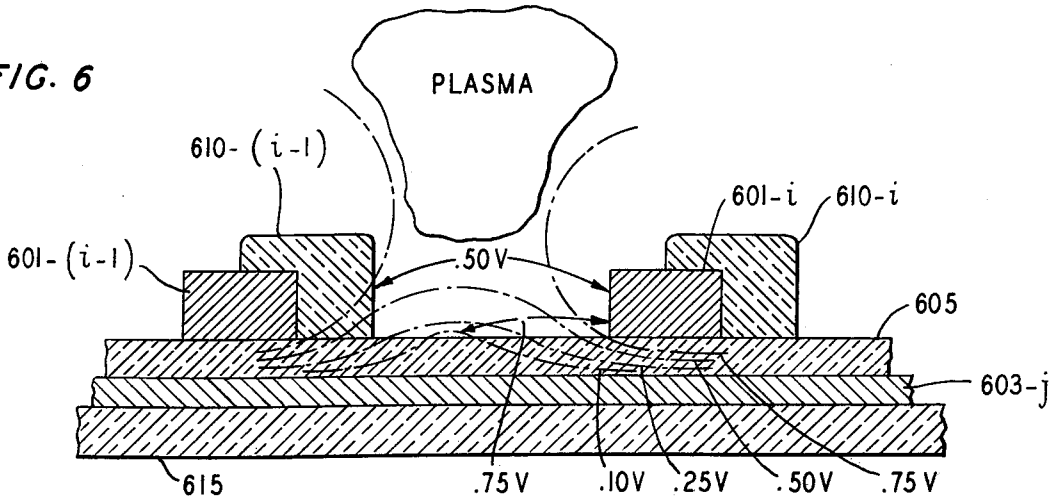
FIG. 6 shows an elevation view, in crossection, of a basic single-substrate plasma panel construction in accordance with the present invention.

FIG. 6 shows a preferred embodiment of the present invention. The structure in FIG. 6 is similar to that shown in the previous figures in that it comprises first and second substantially orthogonal pluralities of electrodes, each perpendicular pair comprising an electrode from each plurality defining an individual gas discharge cell. However, only a single substrate 615 is used to provide support for the entire structure under typical gas pressures. A dielectric layer 605 is used to separate the electrodes **601-*i* and 603-*j*. This structure is similar in some respects to that illustrated in the above-cited U.S. Pat. No. 3,646,384 issued to F. M. Lay. However, the structure presented in the Lay patent is modified, in one aspect, to the extent that each of a plurality of dielectric barriers 610-*i* of the same general type shown above in FIGS. 4 and 5 is laid down on substrate 605 in such manner that it partially overlaps the associated top electrode 601-*i*. In operation, a discharge takes place between in electrode 601-*i* and underlying electrode 603-*j* in a position along the upper surface of substrate 605 which is in contact with the enclosing gaseous atmosphere. A confining envelope 620 (not shown explicitly in FIG. 6) containing a standard gaseous atmosphere (e.g., 99 percent neon, 1 percent argon) encloses the entire array of substrate and associated electrodes and dielectric barriers. Physical connections to the electrodes 601-*i* and 603-*j* are not shown but are effected in standard fashion. No external connections to the dielectric barriers 610-*i*** are required.

FIG. 6 also illustrates the discharge phenomenon in terms of equipotential lines. Thus, as noted earlier, a discharge (and associated glow) occur in the plasma atmosphere only in an area where a sufficient potential differential exists. An approximation to the actual field pattern generated in a single-substrate discharge cell is presented in FIG. 6 by the long-dash-short-dash lines with illustrative potential designations .10V, .25V, .50V, and .75V (where V is the applied potential differential between electrodes **601-*i* and 603-*j*). It occurs under typical gas composition and pressure conditions that the volume of gas exposed to a voltage differential of at least .75V experiences a glow discharge. Thus in FIG. 6, the area above electrode 603-*j* bounded by the left side of electrode 601-*i* and the rightmost point where the .10V equipotential line intersects the top surface of dielectric layer 605** defines the extent of the glow discharge.

Figure 7:
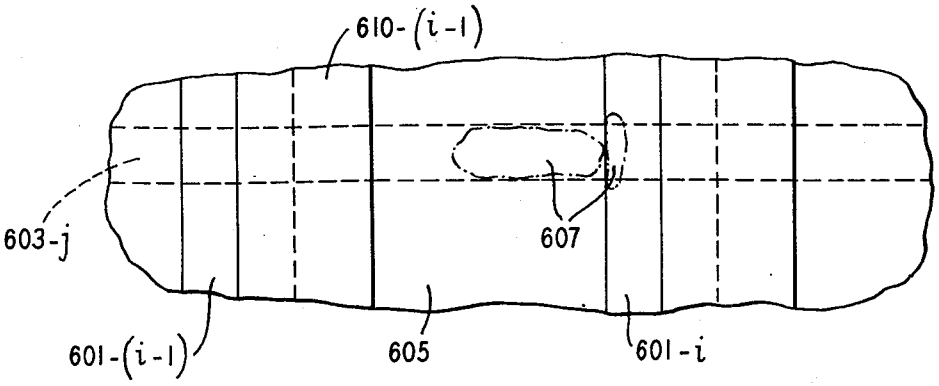
FIG. 7 shows a plan view of the structure of FIG. 6.

FIG. 7 shows a plan view of a portion of the structure shown in FIG. 6. The discharge is shown in FIG. 7 as the clouded area 607. The discharge takes place only between that area overlying electrode **601-*i* and (in alternate half cycles) that overlying that portion of electrode 603-*j* having a capacitance due solely to the dielectric substrate overlaying it. The clouded portion 607** assumes the general form of an "*i*". That is, when operated in the a.c. mode, an equilibrium condition between total charge transferred in discharges during alternate half cycles exists. The bare metal electrode 601 when acting as cathode can, of course, support a very high current density but the dielectric surface 605 under the glow when 603-*j* is cathode can support a relatively limited current density. Thus the glow area on conductor 601-*i* is very small (the "dot" on "*i*") compared to that over the dielectric over conductor 603-*j* (the vertical stem of the "*i*").

Figure 8:
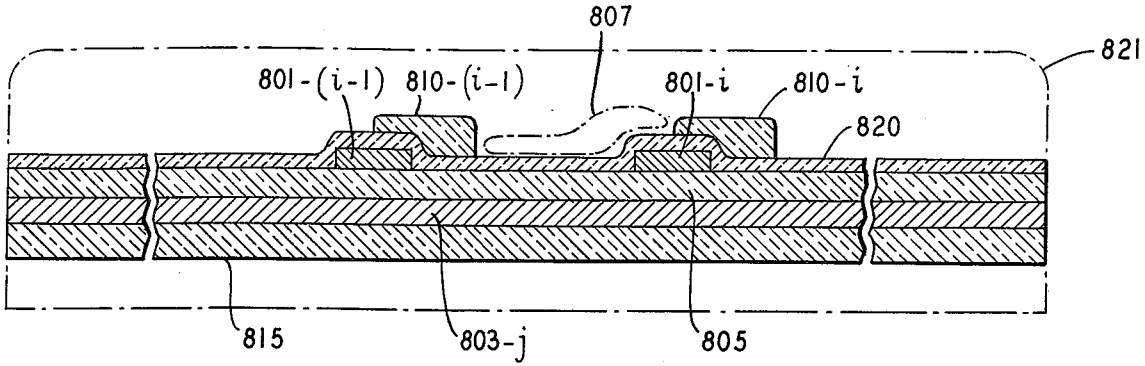
FIG. 8 shows a variation of the structure of FIGS. 6 and 7 featuring an overlaid antisputtering dielectric layer.

FIG. 8 shows an alternative embodiment of the basic structure shown in FIGS. 6 and 7. In particular, in addition to the elements shown in FIG. 6 there is shown in FIG. 8 in crossection an additional dielectric layer 820 overlaying the top conductors 801-*i* and underlying the dielectric barriers, here designated 810-*i*. 805 is the same type dielectric layer used in the structure shown in FIGS. 6 and 7. Similarly, the electrodes 801-*i* and 803-*j* and the substrate are of the same type shown in FIGS. 6 and 7. A plan view of the structure shown in FIG. 8 is substantially similar to the structure illustrated by FIG. 7. The function of the dielectric layer 820 is to prevent sputtering of the exposed metal electrodes when the discharge occurs immediately over such electrodes.

As will be appreciated from the discussion of FIGS. 6 and 7 above, the introduction of the additional dielectric layer 820 in FIG. 8 has the effect of adding a corresponding additional series capacitance in the discharge path. This in turn causes a glow spreading along the conductor 801-*i* similar to the body of the "*i*" shown to occur in the structure of FIGS. 6 and 7. The pair of alternating glows over the conductors 801-*i* and 803-*j* therefore gives a visual impression of a "T". If the capacitance per unit area of the dielectric layers 805 and 820 are equal, the stem and crossbar of the "T" will be equal in area.

Figure 9:
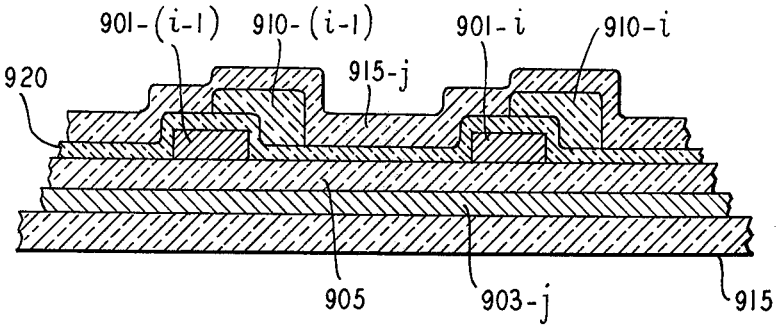
FIG. 9 shows an elevation view in crossection of a variation of the structure of FIGS. 6–8 including sets of orthogonal barriers for confining discharges to two-dimensional windows on a plane parallel to the substrate.
Figure 10:
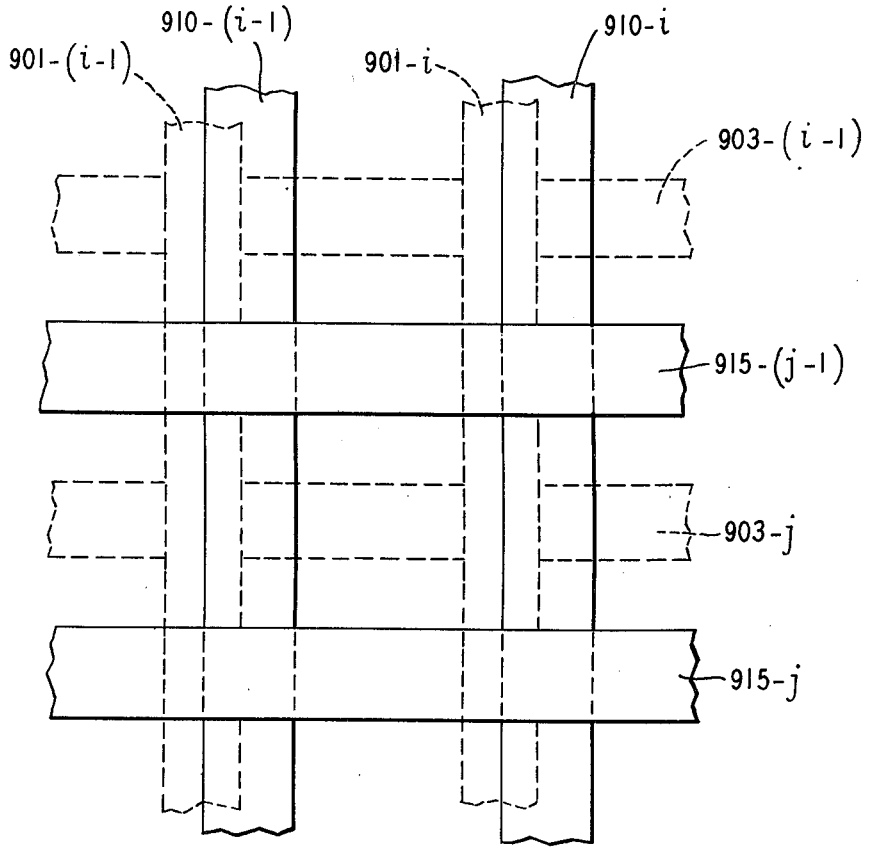
FIG. 10 shows a plan view of the structure of FIG. 9, illustrating these windows.

FIGS. 9 and 10 show a further refinement of the structure shown in FIGS. 6—8. In particular, in a single substrate gaseous discharge panel there is introduced a grid of dielectric barriers overlaying the conducting electrodes in each perpendicular direction. That is, instead of containing the spread of glow discharge in only one direction on the plane of the substrate, e.g., the left-to-right direction in FIGS. 6–8, the spread is confined in both directions on this plane.

In particular, as shown in FIG. 9, a substrate 915 is overlaid by the usual pluralities of conductors 901-*i*, and 903-*j*, $i,j = 1,2 \ldots ,N$, dielectric layer 905, and the antisputtering dielectric layer 920 (substantially similar to layer 820 in FIG. 8). The barriers 910-*i* block the left-to-right glow discharge as do barriers 810-*i* in FIG. 8. In addition, however, there is laid down atop barriers 910-*i* and dielectric layer 920, a plurality of barriers 915-*j*, $j = 1,2 \ldots ,M$, in a direction substantially perpendicular to the direction of barriers 910-*i*. The effect, then, is to create a planar array of "windows" through which may be "seen" the discharge overlying the intersection of perpendicular conducting electrodes positioned on either side of a substantially planar dielectric substrate as shown in FIG. 10. The separating dielectric layer 905 and antisputtering layer 920 are advantageously spread with uniform thickness over the entire substrate 915 and covering respective sets of electrodes 903-*j* and 901-*i*. Accordingly, they are not shown explicitly in the plan view of FIG. 10. As in connection with the structures in FIGS. 6–8, the structure shown in FIG. 9 gives rise, when appropriate standard write and sustain potentials are applied to the conducting electrodes, to a gaseous discharge which occurs in the gas immediately overlying the dielectric layer 920 in the "wells" defined by the grid of dielectric barriers. When no antisputtering layer 920 is used, the discharge occurs, of course, in part over the exposed electrodes. In no case, however, is the discharge obscured by electrodes or dielectric layers, except for the transparent encompassing envelope. Therefore the full brilliancy of the gas discharge is visible and the discharge is contained within a well-defined area associated with a matrix of crosspoints in the two-dimensional array of conducting electrodes.

For purposes of clarity of description, many of the element dimensions in the drawing have been exaggerated. Typical geometrical parameters for single-substrate plasma panels in accordance with FIGS. 6–8 are:

electrode width — 0.010 inch
electrode thickness — 0.001 inch
electrode spacing — 0.040 inch (horizontal and vertical)
substrate thickness — 0.100 inch
dielectric layer thickness — 0.001 inch
maximum barrier height — 0.003 inch
barrier width — 0.015 inch (horizontal and vertical)

Typical material used in fabricating single-substrate plasma panels in accordance with the present invention are:

substrate — Forsterite ceramic
dielectric barriers — ESL No. 4608 dielectric coating
electrodes — thick film gold, ESL No. 8835
antisputtering layer — ESL No. 4608
envelope — soda-lime glass
operating gas — 99% neon, 1% argon at a pressure of 500 mm Hg.

The above-cited ESL No. 4608 dielectric coating (and other materials denoted by ESL numbers) is manufactured by Electroscience Laboratories, Pennsauken, N.J. It has also proven advantageous to enhance the emission qualities of the dielecric layers such as 805 and 820 to vacuum deposit a thin layer of high electron emission material such as $CeO_2$ or BaO on their exposed surfaces. Standard thick film process technology as described, e.g., in "Thick Film Materials for Electro-Optical Applications," by S. J. Stein, *Proc.* 1972 *Electronic Components Conference*, Washington, D.C., May 15–17, 1972, may be used in fabricating the structures on the substrates. When complete, the substrates are enclosed in the glass envelope in standard fashion. The envelope is then evacuated and refilled with the above-cited operating gas mixture.

As will be appreciated by those skilled in the art, initial ionization required when starting up a gas panel when new or after a considerable period of inaction, may readily be obtained by including a small amount of radioactive material within the envelope, by exposing the gas mixture to external ultraviolet light, or by any other standard means. Because of the essentially open structure of the plasma panel in accordance with the present invention, the speed and uniformity of distribution of this initial ionization is superior to that of the Bitzer plasma panel. Further, because all operating structure is built up on a single plane, the difficult alignment problems of the more standard sandwich panels are avoided, while exposing the entire glow discharge to view.

Write, erase and sustain signals, and addressing and drive circuitry for deriving such signals for the plasma panel of the present invention may be substantially identical to that used in sandwich type panels in the prior art.

Figure 12:
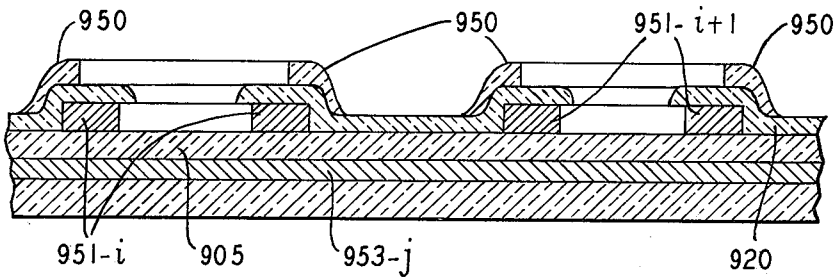
FIGS. 11 and 12 show a useful variation of the shape of one of the orthogonal conductors which can be used in the plasma panel constructions illustrated in FIGS. 6–10.
Figure 11:
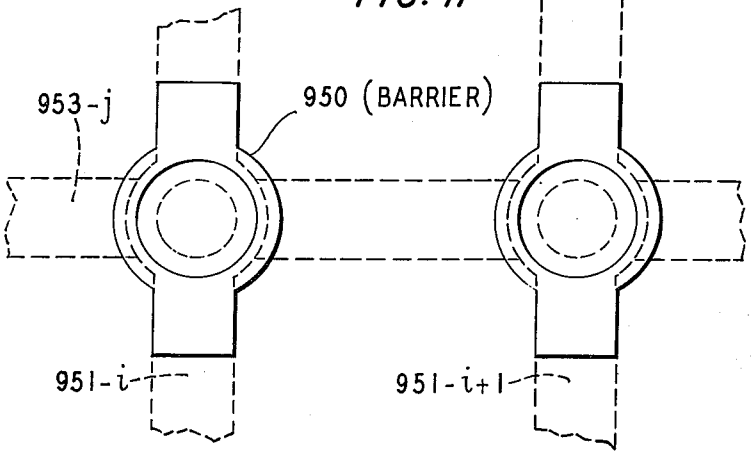

While particular shapes for the electrodes and dielectric barriers have been shown in the drawing and described above, it is clear that a variety of particular shapes may prove convenient in particular circumstances. Thus while the straight linear electrodes shown tend to give rise to a T-shaped discharge, e.g., it is quite elementary to reshape these electrodes, or one of them, in the vicinity of a desired discharge to obtain a somewhat different discharge shape. FIGS. 11 and 12 show such a redefinition of the vertical conductors and associated dielectric barriers to effect a reshaping of the glow discharge. FIG. 12 is an elevation view of a cut through the center of the circles in FIG. 11.

Similarly, different particular relative positioning of electrodes, e.g., non-orthogonal electrode, may be desired in some cases. It is clear that the disclosed single substrate configuraton gives rise to much greater flexibility in positioning, alignment and shaping of electrodes as compared with the more standard sandwich type plasma panels or other single substrate plasma panels.

Though not mentioned specifically in the preceding discussion, it is usually desirable to include (typically around the periphery of the panel) a number of permanently "on" keep-alive cells to facilitate panel start-up and generally to enrich the gaseous atmosphere in ion and photon content. The structure for such cells is identical to that described above, and typical functioning thereof is described in U.S. Pat. No. 3,654,507, issued Apr. 4, 1972 to Caras et al. See also Holz, "The Primed Gas Discharge Matrix Displays," *Proc. of the S.I.D.*, vol. 13, No. 1, First Quarter 1972, pp. 1–5.

Drive circuits useful in connection with the above-described single substrate plasma panel are substantially identical to those used in sandwich-type plasma panels.

Other particular geometric, physical or materials parameters than those illustratively provided above may, of course, be used in constructing a plasma panel in accordance with the present invention.

What is claimed is:

1. A gas discharge panel comprising a substantially planar dielectric substrate, a first plurality of spaced electrodes positioned on said substrate, a first dielectric layer covering said first plurality of electrodes, a second plurality of spaced electrodes positioned on said first dielectric layer and overlaying at least some of said first plurality of electrodes, a first plurality of dielectric barriers overlaying said first dielectric layer each of said barriers being positioned at least partly between an associated pair of said second plurality of electrodes, an envelope enclosing said substrate and electrodes and barriers on said substrate, said envelope being substantially transparent in an area above said second set of electrodes, said envelope also containing a confined ionizable atmosphere, and a dielectric layer covering said second plurality of electrodes, thereby shielding said second plurality of electrodes from said ionizable atmosphere.

2. A panel according to claim 1 further comprising a second plurality of dielectric barriers, each of which overlays a plurality of barriers of said first plurality of barriers, each of said second plurality of barriers being positioned over said substrate at a position at least partially between an associated pair of electrodes of said first plurality of electrodes, said first and second pluralities of barriers thereby forming a plurality of two-dimensional apertures.

3. A gas discharge panel comprising a substantially planar dielectric substrate, a first plurality of spaced electrodes positioned on said substrate, a first dielectric layer covering said first plurality of electrodes, a second plurality of spaced electrodes positioned on said first dielectric layer and overlaying at least some of said first plurality of electrodes, a first plurality of dielectric barriers overlaying said first dielectric layer each of said barriers being positioned at least partly between an associated pair of said second plurality of electrodes, an envelope enclosing said substrate and electrodes and barriers on said substrate, said envelope being substantially transparent in an area above said second set of electrodes, said envelope also containing a confined ionizable atmosphere, a dielectric layer covering said second plurality of electrodes, thereby shielding said second plurality of electrodes from said ionizable atmosphere, and a second plurality of dielectric barriers, each of which overlays a plurality of barriers of said first plurality of barriers, each of said second plurality of barriers being positioned over said substrate at a position at least partially between an associated pair of electrodes of said first plurality of electrodes, said first and second pluralities of barriers thereby forming a plurality of twodimensional apertures.

* * * * *

UNITED STATES PATENT AND TRADEMARK OFFICE

CERTIFICATE OF CORRECTION

PATENT NO. : 3,935,494

DATED : January 27, 1976

INVENTOR(S) : George W. Dick and Walter B. Hatfield

It is certified that error appears in the above-identified patent and that said Letters Patent are hereby corrected as shown below:

Column 2, line 23, "systems" should read --system--;

line 29, "wires" should read --wire--;

line 45, "three" should read --there--.

Column 5, line 57, "56" should read --506--;

line 66, "taht" should read --that--.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*